US011143197B2

(12) United States Patent
Müller et al.

(10) Patent No.: US 11,143,197 B2
(45) Date of Patent: Oct. 12, 2021

(54) COVERED RADIAL FAN WHEEL WITH A PERIODICALLY AND ASYMMETRICALLY SHAPED PLATE

(71) Applicant: ebm-papst Mulfingen GmbH & Co. KG, Mulfingen (DE)

(72) Inventors: Jens Müller, Künzelsau (DE); Daniel Gebert, Öhringen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 100 days.

(21) Appl. No.: 16/607,321

(22) PCT Filed: Aug. 22, 2018

(86) PCT No.: PCT/EP2018/072693
§ 371 (c)(1),
(2) Date: Oct. 22, 2019

(87) PCT Pub. No.: WO2019/048241
PCT Pub. Date: Mar. 14, 2019

(65) Prior Publication Data

US 2020/0080565 A1 Mar. 12, 2020

(30) Foreign Application Priority Data

Sep. 6, 2017 (DE) ..... 10 2017 120 537.3

(51) Int. Cl.
*F04D 29/28* (2006.01)
*F04D 29/66* (2006.01)
(Continued)

(52) U.S. Cl.
CPC ..... *F04D 29/281* (2013.01); *F04D 29/666* (2013.01); *F04D 29/023* (2013.01);
(Continued)

(58) Field of Classification Search
CPC ..... F04D 29/281; F04D 29/30; F04D 29/666; F04D 29/667; F05D 2250/70
See application file for complete search history.

(56) References Cited

U.S. PATENT DOCUMENTS 8,562,297 B2 * 10/2013 Yen ..... F04D 29/282 416/186 R
8,932,019 B2 * 1/2015 Bohl ..... F04D 29/162 416/182

(Continued)

FOREIGN PATENT DOCUMENTS

| | | |
|---|---|---|
| EP | 3 048 303 A1 | 7/2016 |
| JP | 2008 223741 A | 9/2008 |
| JP | 2011 080409 A | 4/2011 |

OTHER PUBLICATIONS

International Search Report and Written Opinion in German for International Application No. PCT/EP2018/072693, dated Nov. 29, 2018, 11 pgs.

(Continued)

*Primary Examiner* — Ninh H. Nguyen
(74) *Attorney, Agent, or Firm* — Dickinson Wright PLLC

(57) ABSTRACT

The present disclosure relates to a radial fan wheel having a plurality of fan wheel blades arranged in a blade ring and at least one plate that, at least in sections, covers the fan wheel blades axially on the front side, wherein two adjacent fan wheel blades form a blade channel therebetween, the flow cross section of which is axially limited by the plate; an axial width of the blade channel increases to a maximum (M) at least along an outer periphery of the radial fan wheel starting from a suction side (S) of a fan wheel blade limiting the blade channel in the direction of a pressure side (D) of the adjacent fan wheel blade limiting the blade channel; wherein the maximum lies on a radial section of the fan wheel, which radial section lies between 55 and 95% of the distance (Continued)

between the suction side (S) of the fan wheel blade limiting the blade channel and the pressure side (D) of the adjacent fan wheel blade limiting the blade channel such that the plate, when viewed in the circumferential direction, has an asymmetrical shape between two adjacent fan wheel blades.

11 Claims, 3 Drawing Sheets

(51) Int. Cl.
*F04D 29/02* (2006.01)
*F04D 29/42* (2006.01)

(52) U.S. Cl.
CPC ..... *F04D 29/4226* (2013.01); *F04D 29/667* (2013.01); *F05D 2250/70* (2013.01)

(56) References Cited

U.S. PATENT DOCUMENTS

| | | | | |
|---|---|---|---|---|
| 9,989,073 | B2 * | 6/2018 | Hwang | F04D 29/281 |
| 2016/0281731 | A1 * | 9/2016 | Kim | F04D 29/282 |

OTHER PUBLICATIONS

German Search Report dated Mar. 26, 2019.

* cited by examiner

COVERED RADIAL FAN WHEEL WITH A PERIODICALLY AND ASYMMETRICALLY SHAPED PLATE

RELATED APPLICATIONS

This application claims priority to German Patent Application No. 10 2017 120 537.3, filed Sep. 6, 2017, and PCT/EP2018/072693, filed Aug. 22, 2018, the entire contents of which are incorporated herein by reference in their entirety.

FIELD

The present disclosure relates to a radial fan wheel having a plurality of fan wheel blades arranged in a blade ring and at least one plate that, at least in sections, covers the fan wheel blades axially on the front side.

BACKGROUND

Radial fan wheels are known in the prior art in various implementations and are used in a variety of fans for different purposes. In this context, it is also known that flow separations are to be avoided as much as possible as they reduce the efficiency of the fans or blowers and cause an increase in noise generation. Typically, the suction side of the fan wheel blades is prone to flow separations in use due to overloading of the boundary layers while the flow abuts the pressure side of the fan wheel blades.

Efforts for increasing efficiency have already been made, for example, using fan wheels as disclosed by DE 10 2010 009 566 A1. Such fan wheels work very well in practice, but it would be desirable to further stabilize the flow in the suction side area of the fan wheel blades to achieve additional benefits for increasing efficiency and reducing noise generation.

BRIEF SUMMARY

Thus, the present disclosure provides a fan wheel that leads to increased efficiency and improved noise behavior in radial fans.

These results are achieved by the combination of feature as recited in claim 1.

According to the present disclosure a radial fan wheel is provided having a plurality of fan wheel blades arranged in a blade ring and at least one plate that, at least in sections, covers the fan wheel blades axially on the front side, wherein two adjacent fan wheel blades form a blade channel therebetween, the flow cross section of which is axially limited by the plate. The axial width of the blade channel increases to a maximum at least along an outer periphery of the radial fan wheel starting from a suction side of a fan wheel blade limiting the blade channel in the direction of a pressure side of the adjacent fan wheel blade limiting the blade channel. It is further intended that the maximum lies on a radial section of the fan wheel, which radial section lies between 55 and 95%, preferably between 65 and 80%, of the distance between the suction side of the fan wheel blade limiting the blade channel and the pressure side of the adjacent fan wheel blade limiting the blade channel, such that the plate, when viewed in the circumferential direction, has an asymmetrical shape between two adjacent fan wheel blades.

The asymmetrical design of the plate of the radial fan wheel according to the present disclosure results in a narrowing of the blade channel in the suction side area of the fan wheel blade and in an extension of the blade channel and/or its flow cross section in the pressure side area of the fan wheel blade. As a result, the flow in the suction side area is stabilized and a flow separation is prevented or minimized. Specifically, the extension of the flow cross section is accomplished without abruptly changing the configuration of the flow cross section and thus advantageously using a continuous curvature of the plate in a circumferential direction.

In a typical and advantageous embodiment, the plate of the radial fan wheel is formed identical in shape between all adjacent fan wheel blades, such that the flow channels extending between the fan wheel blades are also identical in shape.

In addition, it is advantageous to provide an embodiment of the radial fan wheel, in which the fan wheel blades have a constant axial width, particularly at the outer radius of the radial fan wheel. Furthermore, all the fan wheel blades of the blade ring are formed identical in shape in one preferred embodiment.

The radial fan wheel of the present disclosure can also be defined by mathematical expressions, wherein the axial width of each blade channel along the outer periphery of the radial fan wheel is determined by formulas $$B(x) = BS + BE - BE\left[\frac{P - X}{P}\right]^2 \text{ with } X \leq P \text{ and}$$

$$B(x) = BS + BE - BE\left[\frac{X - P}{1 - P}\right]^2 \text{ with } X > P \text{ and } 0 < P < 1.$$

Therein, BS is an axial width of the blade channel at the fan wheel blade, BE is the extension of the axial width of the blade channel to the maximum, P is a position of the maximum of the axial width of the blade channel starting from the suction side of the fan wheel blade limiting the blade channel, and X is a circumferential direction of an unfolded section along the contour of the plate, i.e., a curvature along the outer contour of the radial fan wheel. According to the formulas the axial width of each blade channel increases to the maximum at the position P and then decreases again. The formulas express the curvature of the axial width of the blade channel in the circumferential direction between two adjacent fan wheel blades. At the adjacent fan wheel blades, the value of the axial width is equal to BS. In the area therebetween the axial width of the blade channel increases by the extension BE with the maximum of the axial width B being positioned off center.

With the flow on the suction side of the fan wheel blades typically separating at the cover plate the positive effect of the asymmetrical extension of the axial width of the flow cross section of the flow channel on the efficiency at the suction side cover plate is enhanced. Thus, the plate is provided by the suction side cover plate in an advantageous embodiment. However, the present disclosure is not limited thereto, such that the plate may also be embodied by the bottom plate, which generally also forms at least portions of the hub of the radial fan wheel. Finally, an embodiment variant is included, in which the extension of the axial width of the flow cross section of the flow channel is formed by both the bottom and the cover plate with a corresponding asymmetrical contour on both sides. A further embodiment comprises the asymmetrical plate being formed by the suction side cover plate and the bottom plate extending parallel to an axial plane running perpendicularly opposite a rotational axis of the radial fan wheel.

The fan wheel blades are preferably curved in the circumferential direction and are flush with the outer edge of the bottom plate and/or the cover plate.

In an embodiment, the bottom plate completely covers the axial front sides of the fan wheel blades and the cover plate partially covers the opposite axial front sides of the fan wheel blades going radially inward from an outer radius of the radial fan wheel. Thus, the axial front sides of the fan wheel blades on the suction side are exposed in the area of the clear width of the suction opening.

In another exemplary embodiment, the cover plate forms the suction opening extending around the rotational axis and the asymmetrical shape of the cover plate transitions to a symmetrical form in a direction facing radially inward towards the suction opening. The suction opening itself or an existing portion radially abutting the suction opening will then be annular.

Other advantageous embodiments of the present disclosure are identified in the dependent claims and/or will be presented in further detail below along with the description of the preferred embodiment of the present disclosure with reference to the figures. In the drawings:

BRIEF DESCRIPTION OF THE DRAWINGS

Like reference numerals denote like parts or elements throughout the figures.

DETAILED DESCRIPTION

Figure 1:
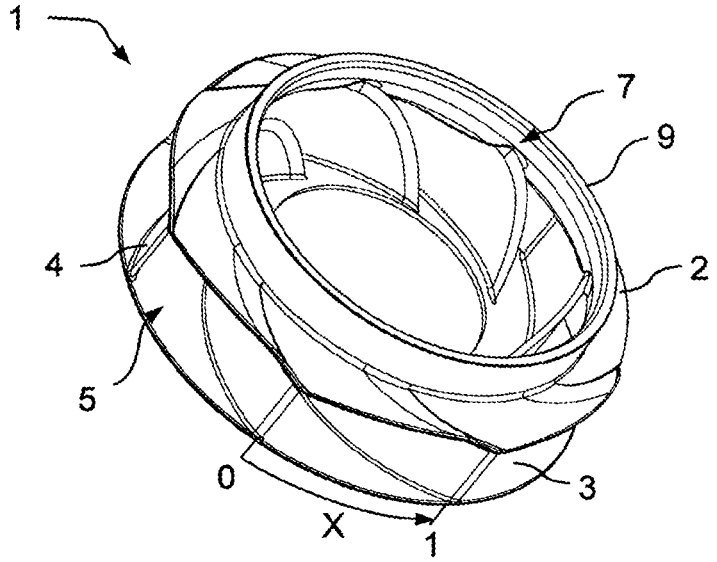
FIG. 1 shows a perspective view of an exemplary embodiment of a radial fan wheel.
Figure 2:
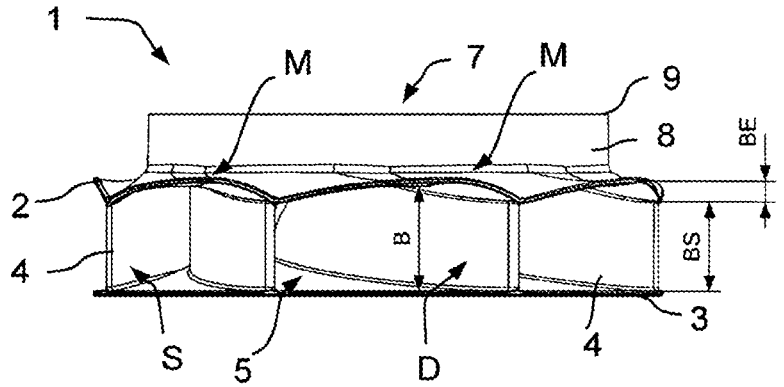
FIG. 2 shows a side view of the exemplary embodiment of the radial fan wheel of FIG. 1.

FIGS. 1 and 2 show an exemplary embodiment of a radial fan wheel 1 having a plurality of fan wheel blades 4 arranged in a blade ring and curved backwards, the lower axial front sides of which are completely covered by the bottom plate 3 extending parallel to an axial plane running perpendicularly opposite the rotational axis of the radial fan wheel 1. On the axially opposite front side, the fan wheel blades 4 are partially covered by the suction side cover plate 2, wherein the fan wheel blades 4 are exposed in an area of the suction opening 7 of the radial fan wheel 1 and extend towards the bottom plate 3 with an arcuate radial leading edge. The suction opening 7 is formed by the circular periphery 9. Each pair of adjacent fan wheel blades 4 forms a blade channel 5 therebetween, the flow cross section of which is determined and limited by the fan wheel blades 4, the planar bottom plate 3 and the cover plate 2. In the illustrated embodiment, all fan wheel blades 4 are identical and have a constant axial width. The flow channels 5 are also identical in shape due to the cover plate 2 also being formed identical in shape between each pair of adjacent fan wheel blades 4.

The axial width B of each blade channel 5 varies over the extension in the circumferential direction of the radial fan wheel 1, being adjusted by the shape of the cover plate, such that it increases from an axial width of the fan wheel blade BS to a maximum M starting from the suction side S of the fan wheel blade 4 in the direction of the pressure side D of the adjacent fan wheel blade 4 and then decreases back to the magnitude of the axial width BS of the adjacent fan wheel blade 4. Meanwhile, the curvature of the cover plate 2 is continuous. The maximum is off center on a radial section of the radial fan wheel 1, which radial section lies at 75% of the distance between the suction side S of the fan wheel blade 4 and the pressure side D of the adjacent fan wheel blade 4 compared to the outer radius of the radial fan wheel 1 in the illustrated embodiment, such that the cover plate 2 has an asymmetrical shape between two adjacent fan wheel blades 4, when viewed in the circumferential direction. While the asymmetrical shape is primarily determined by the outer radius of the radial fan wheel 1, but also extends radially inward over a predetermined length, such that a three-dimensional extension of the axial width is present in the radially outer area of the pressure side D of each fan wheel blade 4. The asymmetrical shape of the cover plate 2 continuously transitions to a symmetrical shape in the direction facing radially inward toward the suction opening 7, with the edge 8 abutting the suction opening already formed as a ring.

Figure 3:
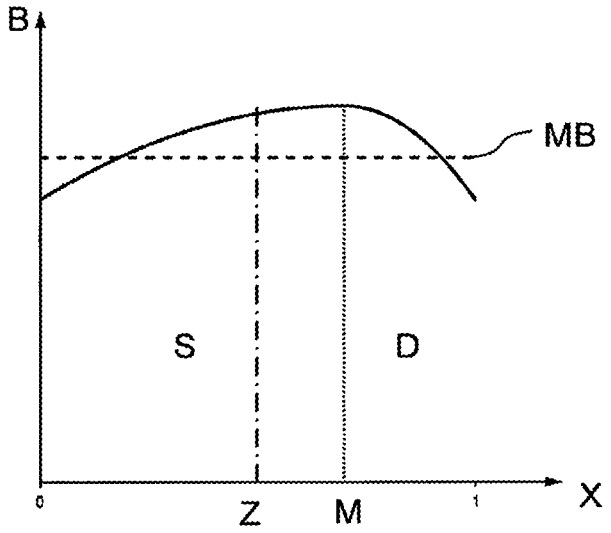
FIG. 3 shows a diagram of the curvature of the axial width of a blade channel along the circumferential direction of the radial fan wheel.

FIG. 3 illustrates a diagram of the curvature of the axial width B of the blade channel 5 along the circumferential direction X of the radial fan wheel of FIG. 1 at its outer radius and therefore the proportion of the flow cross section of one of the flow channels 5 at the outlet of the flow channel. When viewed in the circumferential direction, the center Z of the blade channel 5 between two adjacent fan wheel blades 4 is shown by the dot-dashed line, the suction side of the fan wheel blades 4 being on the left-hand side and the pressure side of the fan wheel blades 4 being on the right-hand side of the center Z. The average axial width MB is represented by the dashed line. Additionally, a dotted line depicts the maximum M of the axial width B at 75% of the distance between the suction side S of the fan wheel blade 4 and the pressure side D of the adjacent fan wheel blade 4.

Figure 4:
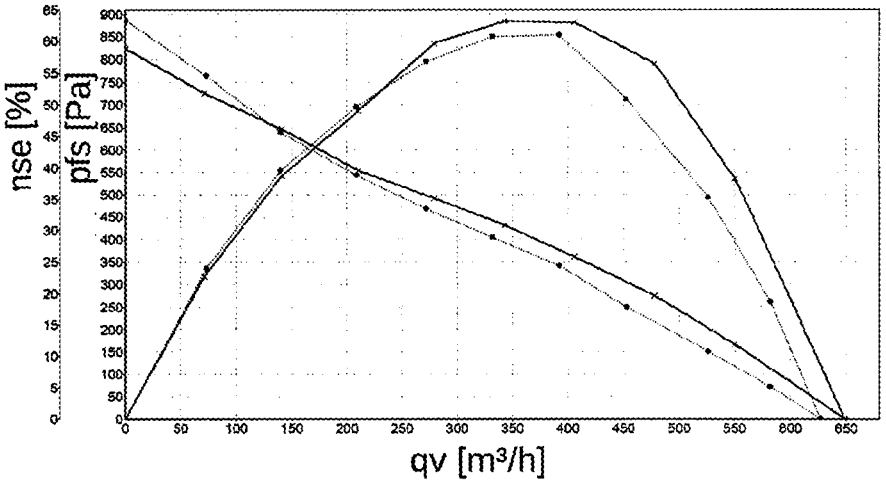
FIG. 4 shows a diagram comparing the efficiency and pressure profile of the radial fan wheel of FIG. 1 with those of a radial fan wheel of the prior art in FIG. 5.
Figure 5:
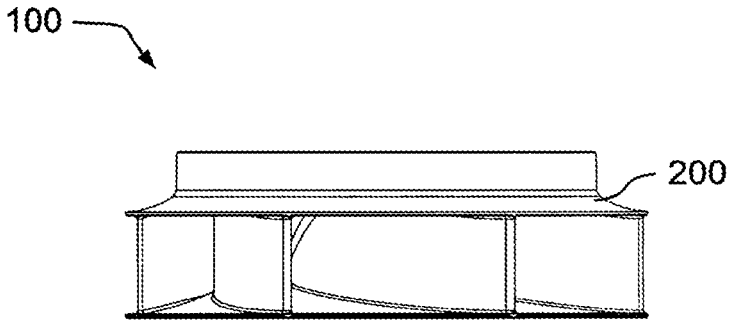
FIG. 5 shows a radial fan wheel of the prior art.

FIG. 4 illustrates a diagram showing characteristic curves of the pressure profile psf [Pa] and the efficiency nse [%] at different volumetric flows qv [m3/h] of the radial fan wheel 1 according to FIG. 1 and the identical radial fan wheel 100 only with a planar cover plate 200 according to FIG. 5, measured during identically designed tests, the solid characteristic line indicating the radial fan wheel 1 according to FIG. 1 with the cover plate 2 and the finely dotted characteristic line indicating the radial fan wheel 100 according to FIG. 5. The advantageous effect with increased peak efficiency already starts at a volumetric flow of about 150 m3/h onwards. The superior pressure profile already starts at about 225 m3/h. Noise generation is reduced by at least 5% in a range starting at 225 m3/h.

All the features disclosed in the present description or the claims can be incorporated into the embodiment according to FIG. 1 and/or features described as alternatives may replace the features disclosed in FIG. 1, although this is not explicitly shown in a separate exemplary embodiment.

The invention claimed is:

1. A radial fan wheel having a plurality of fan wheel blades arranged in a blade ring and at least one plate that, at least in sections, covers the fan wheel blades axially on the front side, wherein two adjacent fan wheel blades form a blade channel therebetween, the flow cross section of which is axially limited by the plate, an axial width (B) of the blade channel increasing to a maximum (M) at least along an outer periphery of the radial fan wheel starting from a suction side (S) of a fan wheel blade limiting the blade channel in the direction of a pressure side (D) of the adjacent fan wheel blade limiting the blade channel, wherein the maximum (M) lies on a radial section of the fan wheel, which radial section lies between 65 and 80% of the distance between the suction side (S) of the fan wheel blade limiting the blade channel and the pressure side (D) of the adjacent fan wheel blade limiting the blade channel such that the plate, when viewed in the circumferential direction, has an asymmetrical shape between two adjacent fan wheel blades, and wherein the axial width (B) of each blade channel along the outer periphery of the radial fan wheel is defined by the formulas $$B(x) = BS + BE - BE\left[\frac{P - X}{P}\right)\Big]^2 \text{ with } X \leq P, \text{ and}$$

$$B(x) = BS + BE - BE\left[\frac{X - P}{1 - P}\right]^2 \text{ with } X > P \text{ and } 0 < P < 1$$

wherein BS is an axial width of the blade channel at the fan wheel blade, BE is the extension of the axial width of the blade channel to the maximum, P is a position of the maximum (M) of the axial width of the blade channel starting from the suction side (S) of the fan wheel blade limiting the blade channel and X is a circumferential direction of an unfolded section along the contour of the plate.

2. The radial fan wheel as recited in claim 1, wherein the plate has a continuous curvature in the circumferential direction.

3. The radial fan wheel as recited in claim 1, wherein the fan wheel blades have a constant axial width (B).

4. The radial fan wheel as recited in claim 1, wherein the adjacent fan wheel blades have an identical axial width (B) at the outer radius of the radial fan wheel.

5. The radial fan wheel as recited in claim 1, wherein the fan wheel blades of the blade ring are formed identical in shape and have an identical axial width (B) at the outer radius of the radial fan wheel.

6. The radial fan wheel as recited in claim 1, wherein the plate is formed identical in shape between all adjacent fan wheel blades.

7. The radial fan wheel as recited in claim 1, wherein the plate is provided by a bottom plate and/or a suction side cover plate.

8. The radial fan wheel as recited in claim 1, wherein the plate is formed as a suction side cover plate and the radial fan wheel has a bottom plate extending parallel to an axial plane running perpendicularly opposite a rotational axis of the radial fan wheel.

9. The radial fan wheel as recited in claim 8, wherein the bottom plate completely covers the axial front sides of the fan wheel blades and the cover plate partially covers the opposite axial front sides of the fan wheel blades (4) going radially inward from the outer radius of the radial fan wheel.

10. The radial fan wheel as recited in claim 8, wherein the cover plate forms a suction opening extending around the rotational axis and the asymmetrical shape of the cover plate transitions to a symmetrical shape in a direction facing radially inward towards the suction opening.

11. The radial fan wheel as recited in claim 10, wherein the cover plate has a ring extending parallel to the rotational axis of the radial fan wheel adjacent to the suction opening.

* * * * *